United States Patent [19]

Turner et al.

[11] Patent Number: 4,958,960

[45] Date of Patent: Sep. 25, 1990

[54] WELL CONDUCTOR SUPPORT STRUCTURE AND METHOD FOR USING

[75] Inventors: James W. Turner; M. Sidney Glasscock, both of Houston, Tex.

[73] Assignee: Exxon Production Research Company, Houston, Tex.

[21] Appl. No.: 354,943

[22] Filed: May 22, 1989

[51] Int. Cl.[5] ..... E02B 17/00

[52] U.S. Cl. ..... 405/195; 166/350; 175/7; 405/203

[58] Field of Search ..... 405/195, 204, 203, 196, 405/198; 166/350, 359, 367; 175/5, 7

[56] References Cited

U.S. PATENT DOCUMENTS

| | | | |
|---|---|---|---|
| 1,867,030 | 7/1932 | Roberts | 166/367 X |
| 3,201,945 | 8/1965 | Sutton | 405/196 |
| 3,316,984 | 5/1967 | Jones | 175/7 |
| 3,380,520 | 4/1968 | Pease | 405/196 X |
| 4,030,310 | 6/1977 | Schirtzinger | 166/367 X |
| 4,142,584 | 3/1979 | Byewer et al. | 166/359 |
| 4,227,831 | 10/1980 | Evans | 175/7 X |
| 4,629,366 | 12/1986 | Rutherford et al. | 405/195 X |

*Primary Examiner*—Dennis L. Taylor
*Attorney, Agent, or Firm*—Keith A. Bell

[57] ABSTRACT

An independent modular structure for providing lateral support for the well conductors of an offshore well platform and a method for designing and using such structure are disclosed. The modular structure can be inserted into a void in the jacket of the well platform. The vertical spacing between adjacent support points on the modular structure is determined by the lateral support requirements of the well conductors. Accordingly, the design of the platform jacket may be optimized without consideration of the lateral support requirements of the well conductors.

16 Claims, 4 Drawing Sheets

WELL CONDUCTOR SUPPORT STRUCTURE AND METHOD FOR USING

Field of the Invention

This invention relates generally to offshore drilling and production platforms. More particularly, but not by way of limitation, the invention pertains to an auxiliary structure for supporting the platform's tubular well conductors, said auxiliary support structure being independent of but integrable with the jacket structure of the platform.

Background

The drilling and production of offshore oil and gas wells are typically performed from a large tower or well platform the base of which is secured to the ocean floor and the top of which extends above the surface of the ocean. Generally, the platform consists of two basic components: the structural steel legs and associated structural framework, and the deck or decks which rest on the tops of the legs. The legs and associated framework are commonly called the "jacket" of the platform. The drilling and production equipment is located on the decks.

Offshore drilling and production operations are conducted through large diameter pipes called "well conductors". These well conductors are typically 20 to 30 inches in diameter and extend from the decks through the jacket and into the ocean floor. A typical offshore drilling platform would have multiple well conductors which must be supported against lateral loads caused by wind, waves, currents, earthquakes, ice movement, or mud slides.

An offshore drilling and production platform has two principal purposes: one, to provide an above-surface deck from which drilling and production operations can be conducted and two, to provide lateral support for the well conductors through which drilling and production operations are to be performed.

Two primary types of jacket structures are battered jackets and compliant piled towers. A battered jacket has legs which diverge from top to bottom, and it is basically a rigid structure with respect to lateral loads. A compliant piled tower is typically used in greater water depths, and it typically has substantially parallel legs. A compliant piled tower can comply with lateral loads without failing, much like a reed in water. Where the term "jacket" is used herein in describing the use of the present invention, it is meant to refer to a compliant piled tower as well as a battered jacket.

The well platform battered jacket 100 shown in FIG. 1 is a geometric tubular steel framework of legs 110, horizontal framing members 120 between the legs 110, and diagonal framing members 130 between the legs 110 and the horizontal framing members 120. As illustrated, diagonal framing members 130 are arranged in a "V" bracing pattern. As will be obvious to those skilled in the art, many other bracing patterns may be used, such as the "X" bracing pattern shown in FIG. 5. A compliant piled tower typically has parallel legs, but it also includes horizontal framing members and diagonal framing members similar to those shown in the battered jacket of FIG. 1. Lateral support for the well conductors is typically provided by means of conductor guide supports 140 that are structurally framed into the horizontal framing members 120 which define the horizontal planes of the platform. Some of the primary factors considered in the design of the jacket 100 are the number of horizontal framing bays, and as a consequence, the number, magnitude, and location of lateral support elements, or conductor guides, which must be provided to insure proper lateral support for the well conductors. These factors affect the numbers, types, and sizes of framing members used in construction of the jacket, as well as the locations at which they are placed.

For instance, since the conductor guides are integral with the structural members of the platform, the vertical spacing between adjacent horizontal framing members 120 is at least partly determined by the requirement to support the well conductors against lateral loads at certain intervals along the conductor length. Different types of lateral loads have varying magnitudes according to depth below the ocean surface, some being greater at the surface, some greater near the ocean floor. Still others can have fairly uniform magnitude at all depths. Lateral loads from wave action are greatest near the surface because water velocity decreases rapidly with increasing depth. Lateral loads from earthquakes or currents can be uniform over the entire conductor length because of relatively uniform water velocities at all depths. Loads from mud slides are greater near the ocean floor.

Lateral loads caused by tilting of a compliant piled tower are directly related to the slope of the structure at each particular depth. Inertial loads from tilting of a compliant piled tower are greatest near the water surface because the magnitude and lateral acceleration of the movement increase as the distance from the pivot point (i.e., the ocean floor) increases.

In addition to supporting the well conductors against lateral loads, the other principal design constraint for well conductors is axial unbraced length. The lateral load conditions discussed above relate to the bending moment in a well conductor at each point along its length and, hence, conductor spans are limited by the capacity of the conductor to withstand the applied lateral loads without bending. Axial unbraced length relates to the conductor's capacity to withstand buckling. The axial buckling load in a well conductor is represented by the weight of the wellhead equipment and the conductor above the span under consideration. As water depth increases, the axial buckling load can become quite large, and buckling of the well conductors is a significant concern. Buckling of the well conductors can be prevented either by reducing the axial unbraced length or by increasing the conductor's diameter to achieve a higher buckling capacity.

In designing a well conductor, it is typically necessary to consider the effect of both lateral loads and buckling. Given that buckling typically predominates near the ocean floor while bending due to lateral loads typically predominates near the ocean surface, it is quite possible that the greatest allowable spans between adjacent lateral support points may be near the center of the conductor length and smallest near the surface and floor. This can result in a requirement for close spacing of horizontal platform framing members near the top and bottom of the jacket, with wider spacing being permissible near the center. Conductor guide supports 140 (see FIG. 1) are mounted to the horizontal framing members 120 and these conductor guide supports 140 in turn support the well conductors by means of guides 150 through which the well conductors are run. Referring now to FIG. 2, the lateral forces experienced by the well conductors 200 are, therefore, transferred through guides 150 to the guide supports 140, which, in turn, transfer lateral forces on the conductors 200 to the horizontal framing members 120 and thence to the legs 110 of the jacket. The vertical spacing $S_1$ between adjacent conductor guide supports 140, and hence between adhacent horizontal framing members 120, is determined by the lateral and axial unbraced length requirements of the well conductors 200, as described above.

Offshore drilling first began in shallow waters less than about 100 feet deep. As exploration continued, producible formations were found in progressively deeper waters. Until depths greater than about 600 feet were encountered, attention to the design for lateral support of the platform's well conductors was not critical since the jacket design generally had a framing bay vertical spacing which was adequate to serve as the spacing for lateral support of the conductors. However, as one approaches a design for operation in water depths greater than 600 feet, especially greater than 1200 feet, the necessity to design for adequate lateral support to prevent axial buckling of the conductors becomes critical. The necessity to provide for proper lateral support of conductors can thus dictate the design of the jacket, requiring the jacket to be designed to have closer framing bay spacing, to provide lateral support points for the conductors, or require the use of larger diameter conductors to maximize the spacing possible between the framing bays of the jacket.

Either expedient to provide for proper lateral support of the conductors entails its own disadvantages. Either the jacket design must be deviated from that which would be best suited for the jacket if its strength and service could be considered apart from the need of conductor lateral support, or larger diameter conductors must be employed than otherwise would be required purely from a drilling and operation standpoint.

A relatively small number of well conductors, therefore, can control the design of the entire jacket. This can result in jacket designs which are much more complicated and much less economical than they would otherwise be if the lateral support of well conductors could be divorced from the jacket design process.

Accordingly, it would be desirable to devise a conductor support structure which would provide for proper lateral support of the conductors and which could be incorporated into the jacket of an offshore platform. This would permit the jacket to be designed apart from any consideration of the vertical spacing of the conductor supports, and it would allow the use of conductors of a diameter best suited for drilling operations without consideration of lateral support for the conductor. Finally, such a design concept would utilize the jacket strength to transfer lateral loads from the conductors to the ocean floor.

Summary of the Invention

This invention provides a method and apparatus for divorcing the well conductor lateral support requirements from the jacket design process. This is accomplished by providing a modular support structure for the well conductors which is separate from but integrable with the structural elements of the platform jacket. The modular well conductor support structure is designed to provide the optimum lateral support for the well conductors without reference to the structural requirements of the well platform jacket. The well platform jacket may be designed for optimum support of the decks and the modular structure, rather than direct lateral support of the well conductors. This allows for a more effective and efficient overall design of the platform jacket with wider vertical spacing of the horizontal framing members. The jacket design incorporates a void into which the modular well conductor support structure can be inserted. The modular structure can then be attached to the jacket, if desired, such as by welding. Upon integration of the modular well conductor support structure with the jacket, lateral loads placed upon the well conductors are transmitted by the modular well conductor support structure to the jacket structure and thence to the ocean floor.

Brief Description of the Drawings

The advantages of the present invention will be better understood by referring to the following detailed description and the attached drawings in which.

Detailed Description of the Invention

Figure 1:
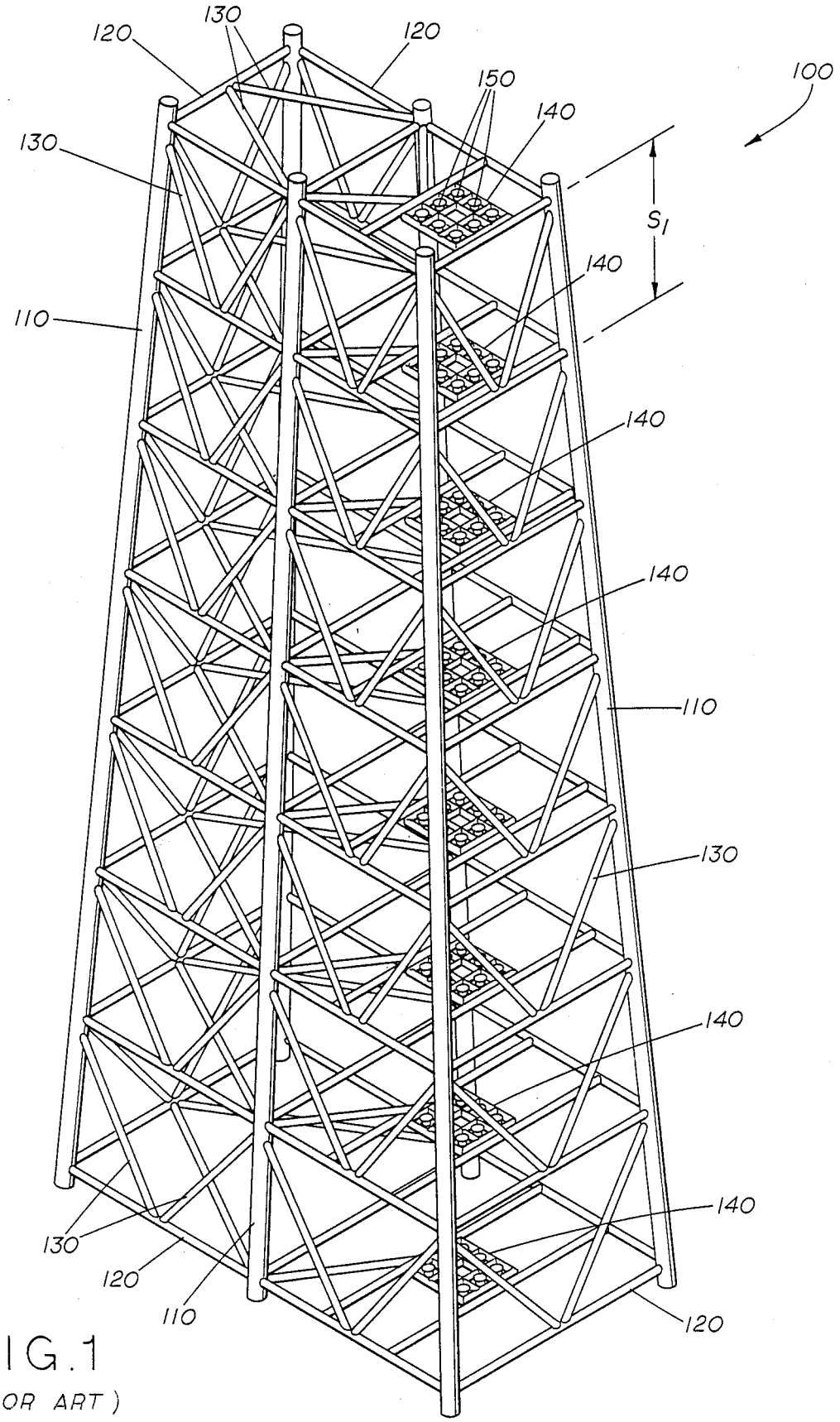
FIG. 1 (PRIOR ART)
FIG. 1 is a perspective view of a typical prior art well platform jacket.
Figure 2:
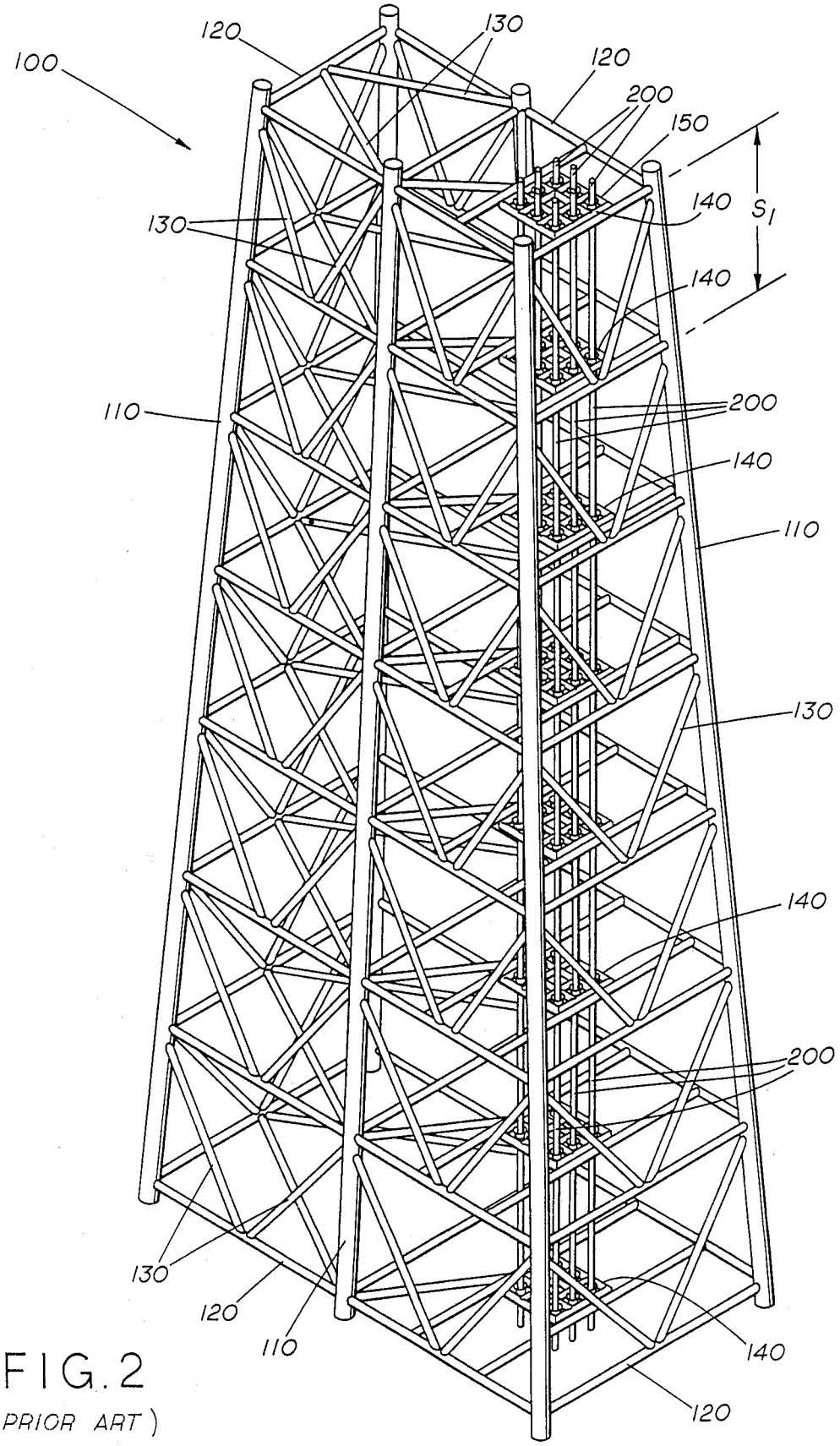
FIG. 2 (PRIOR ART)
FIG. 2 is a perspective view of the well platform jacket of FIG. 1 with well conductors installed.
Figure 3:
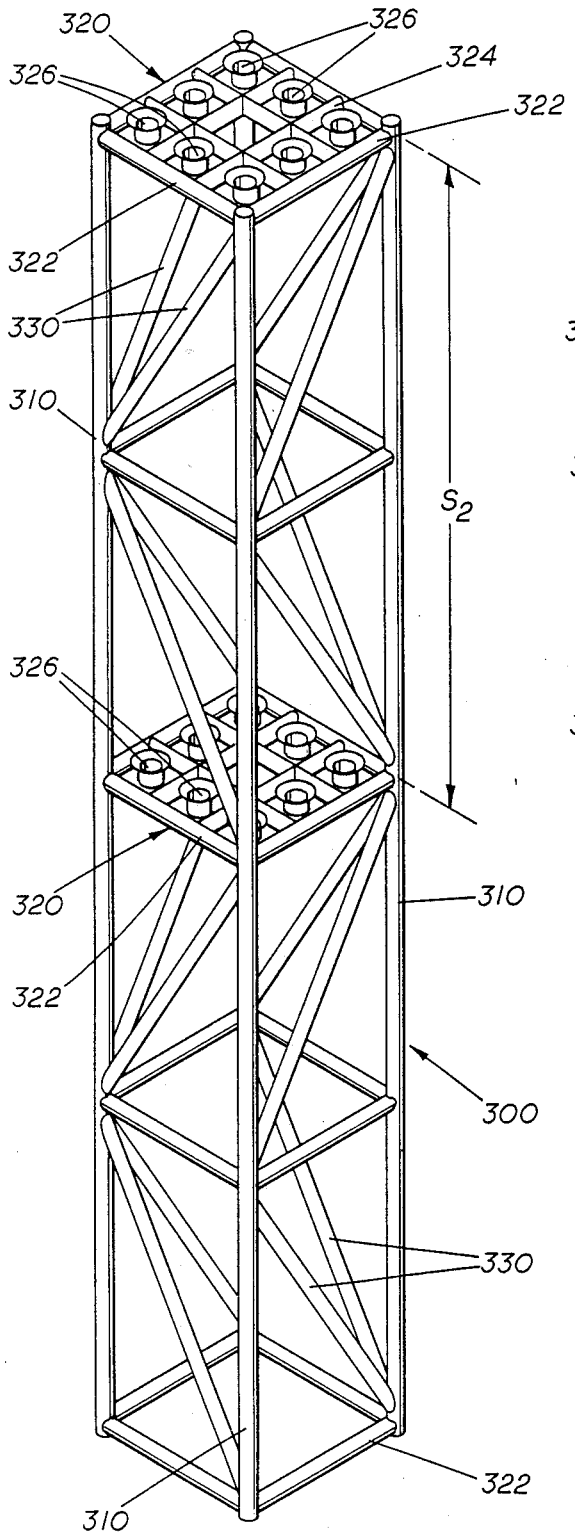
FIG. 3 is a perspective view of a modular support structure of the present invention.

This invention involves the use of a structurally independent module which can be inserted into a void provided therefor in a well platform jacket. As seen in FIG. 3, the modular structure 300 has vertical support members 310 which can be arranged in a variety of patterns, but which are shown here as being parallel and arranged in a rectangular pattern.

Figure 4:
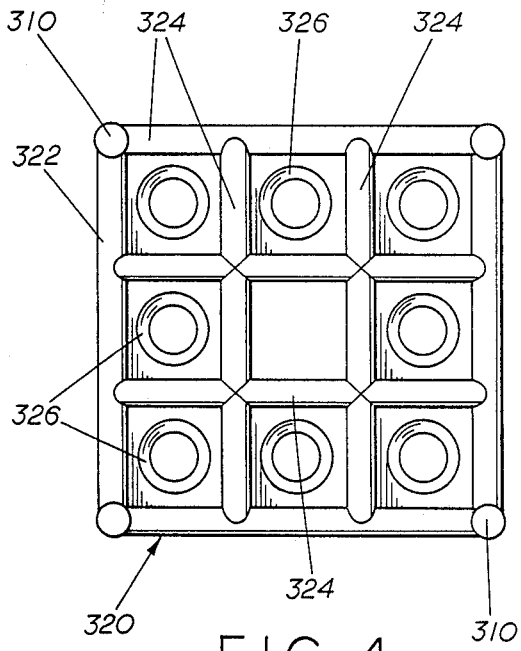
FIG. 4 is a plan view of one level of the modular support structure of FIG. 3.

Attached to the vertical support members 310 are horizontal support members 320, shown in FIG. 4, arranged in a horizontal grouping with a vertical support member 310 at each corner.

The vertical spacing $S_2$ between adjacent horizontal support members 320 is determined by the axial unbraced length and lateral support requirements of the well conductors. Horizontal support members 320 have frames 322 around the perimeter, horizontal beams 324 spanning frames 322 and guides 326 mounted to horizontal beams 324. The well conductors pass through guides 326 as will be shown later.

Modular structure 300 also has diagonal support members 330, which are elongated structural components such as beams, rods or pipes, attached at a first end to a first vertical support member 310 and attached at the second end to a second vertical support member 310 above or below the first point of attachment. The sizing and placement of the vertical, horizontal, and diagonal support members 310, 320, 330 are as required to create a structural framework capable of supporting the well conductors against lateral loads. All lateral loads on the well conductors are transferred via the horizontal support members 320 to vertical support members 310 and thence to the platform jacket. Where the horizontal support member 320 is between horizontal framing members 120 of the jacket, the modular structure 300 acts as a bridge loaded between the support abutments.

Figure 5:
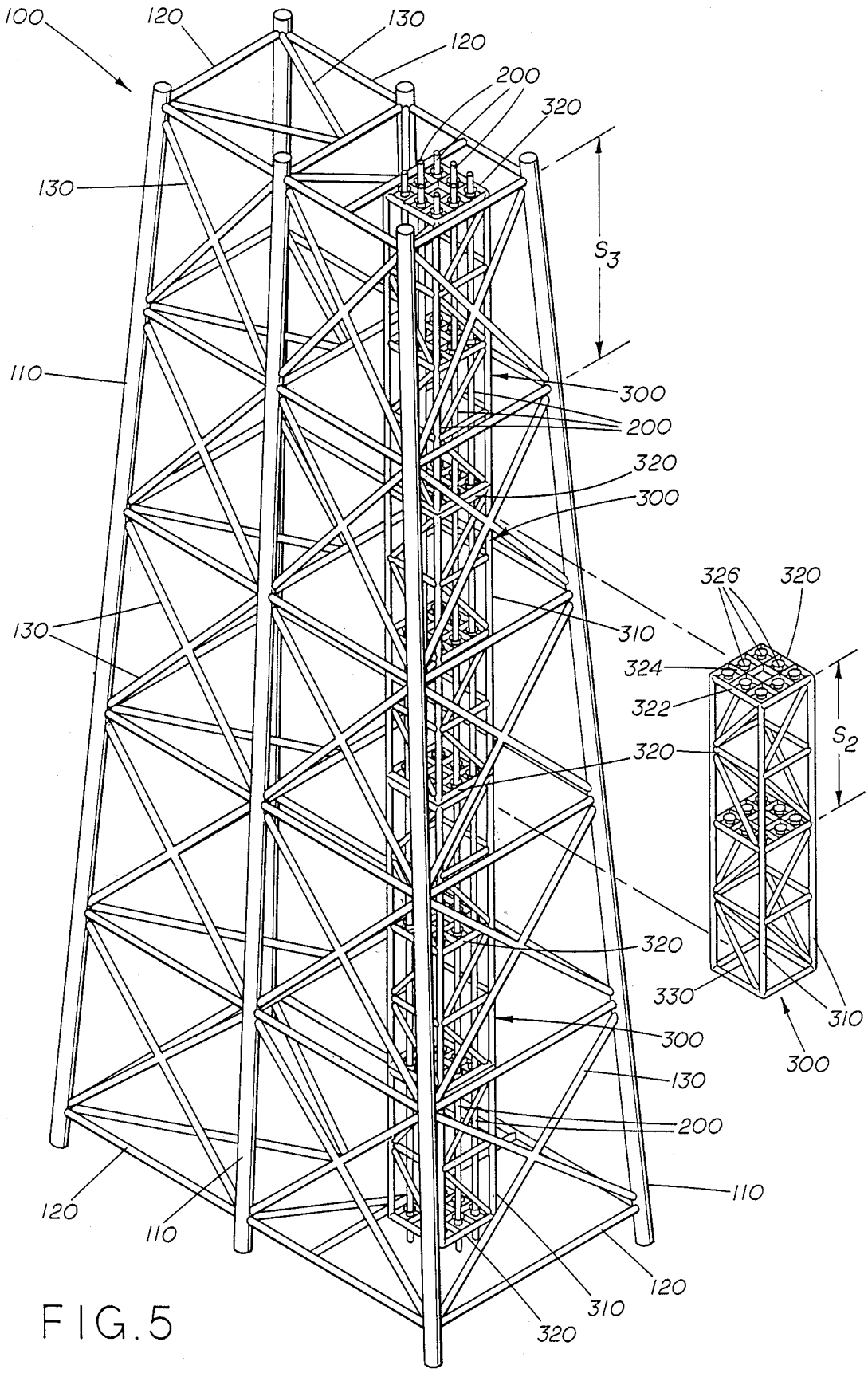
FIG. 5 is a perspective view of a well platform jacket with the modular support structure of FIG. 3 installed.

As seen in FIG. 5, the well platform jacket 100 of the present invention has legs 110, horizontal framing members 120 and diagonal framing members 130 similar to currently known jackets. The difference in the present invention is that vertical spacing $S_3$ between horizontal framing members 120 is calculated based on the requirements of the well platform jacket 100 itself rather than being dictated by the axial unbraced length and lateral support requirements of the well conductors 200. As mentioned before, the present invention could be used in a similar fashion on a compliant piled tower.

As seen in FIG. 5, modular structure 300 is inserted into well jacket 100 in a void provided for that purpose by the jacket design and welded in place. The lateral support requirements of the well conductors 200 determine the vertical spacing $S_2$ of adjacent horizontal support members 320 as described earlier. This leaves the vertical spacing $S_3$ between adjacent horizontal framing members 120 of the jacket to be determined by the overall structural requirements of the well platform jacket 100. Therefore, even though modular structure 300 is mounted within and attached to well platform jacket 100, it is structurally a separate module. This simplifies the design of the jacket 100, and it can result in a vertical spacing $S_3$ greater than $S_2$, resulting in a lower construction cost for the jacket.

The vertical spacing $S_2$ is calculated based upon the combined lateral load profile resulting in smaller spacing near the top and bottom in deep waters, with larger spacing near the center. Studies indicate that a 26 inch diameter conductor in a water depth of about 2500 feet, will permit a maximum vertical spacing between adjacent lateral support points of about 60 feet *ear the bottom, about 80 feet near the top, and as much as 120 feet near the center.

Design of the jacket alone, on the other hand, is a function of the required rigidity and the need to minimize weight and cost. This generally results in increasing the horizontal frame spacing with increasing depth. Jackets used in deeper applications can achieve a spacing of 120 feet near the ocean floor. Therefore, design for conductor lateral support and design for jacket optimization will yield different spacing requirements.

Use of the modular approach of the present invention allows for optimization of each of these design goals. The modular structure 300 provides the necessary support against lateral loads at all depths without influencing the optimum jacket design. Well conductor diameter can also be minimized according to well drilling and operational requirements.

The modular approach allows for a single continuous module within the structure or, alternatively, several independent modules spanning different regions of the structure. Adjacent modules need not be connected, but may be if desired. Vertical support of the modules can be provided at all horizontal framing levels or at as few as one. Typically, vertical support would be provided by welding the modular support structure to one or more of the horizontal framing bays through which it passes. Where vertical support is not provided at a particular horizontal framing level, the modular support frame can move vertically, but not laterally, with respect to the jacket horizontal frames. The decision of whether to Provide vertical support at each horizontal framing level is governed by the structural needs and load paths within the jacket structure. In particular, for jacket launches, it may be desirable to only support each modular support frame at one horizontal framing level in order to avoid inducing axial forces into the modular structure.

The detailed description given here refers to the preferred embodiment of the present invention. Variations on this embodiment will appear obvious to one skilled in the art. To the extent that such variations are equivalent to the invention described here, it is intended that they be encompassed in the following claims.

We claim:

1. A conductor support module for supporting well conductors of an offshore platform, said conductor support module being separate from but integrable with the jacket of said offshore platform, said conductor support module comprising:

a plurality of substantially parallel vertical support members; and a plurality of horizontal conductor support members attached to said vertical support members, the vertical spacing between adjacent horizontal conductor support members being determined by the lateral support requirements of said well conductors;

whereby lateral loads on said well conductors are transferred from said well conductors to said conductor support module and thereby to said offshore platform.

2. A conductor support module as defined in claim 1 wherein each of said vertical support members is a hollow tubular member.

3. A conductor support module as defined in claim 1 wherein each of said horizontal conductor support members comprises:

a horizontal frame;

a plurality of horizontal beams attached to said horizontal frame; and a plurality of conductor guides attached to said horizontal beams.

4. A conductor support module as defined in claim 3 wherein said horizontal frame is in the shape of a rectangle and is attached at each corner to one of said vertical support members.

5. A conductor support module as defined in claim 1 wherein said vertical spacing between adjacent horizontal conductor support members is less than the vertical spacing between adjacent horizontal framing members of said jacket of said offshore platform.

6. A conductor support module as defined in claim 1 further comprising a plurality of diagonal support members attached to said conductor support module in such a manner as to strengthen said conductor support module.

7. A conductor support module for supporting well conductors of an offshore platform; said conductor support module being separate from but integrable with the jacket of said offshore platform, said conductor support module comprising:

a plurality of substantially parallel vertical support members;

a plurality of horizontal conductor support members attached to said vertical support members, the vertical spacing between adjacent horizontal conductor support members being determined by the lateral support requirements of said well conductors; and a plurality of diagonal support members attached to said conductor support module in such a manner as to strengthen said conductor support module;

whereby lateral loads on said well conductors are transferred from said well conductors to said conductor support module and thereby to said offshore platform.

8. A conductor support module as defined in claim 7 wherein each of said vertical support members is a hollow tubular member.

9. A conductor support module as defined in claim 7 wherein each of said horizontal conductor support members comprises:

a horizontal frame;

a plurality of horizontal beams attached to said horizontal frame; and a plurality of conductor guides attached to said horizontal beams.

10. A conductor support module as defined in claim 9 wherein said horizontal frame is in the shape of a rectangle and is attached at each corner to one of said vertical support members.

11. A conductor support module as defined in claim 7 wherein said vertical spacing between adjacent horizontal conductor support members is less than the vertical spacing between adjacent horizontal framing members of said jacket of said offshore platform.

12. An offshore platform comprising:

(a) a plurality of well conductors;

(b) an offshore platform jacket having a void therethrough, said offshore platform jacket having a plurality of horizontal framing members, wherein the vertical spacing between adjacent horizontal framing members is determined without reference to the lateral support requirements of said well conductors;

(c) at least one offshore platform deck supported by said offshore platform jacket; and (d) a structurally separate conductor support module for supporting said well conductors, said conductor support module adapted to be inserted within said void of said offshore platform jacket and attached to said offshore platform jacket, said conductor support module comprising:

a plurality of substantially parallel vertical support members; and a plurality of horizontal conductor support members attached to said vertical support members, the vertical spacing between adjacent horizontal conductor support members being determined by the lateral support requirements of said well conductors; whereby lateral loads on said well conductors are transferred from said well conductors to said conductor support module and thereby to said offshore platform jacket.

13. An offshore platform as defined in claim 12 wherein each of said horizontal conductor support members of said conductor support module comprises:

a horizontal frame;

a plurality of horizontal beams attached to said horizontal frame; and a plurality of conductor guides attached to said horizontal beams.

14. An offshore platform as defined in claim 13 wherein said horizontal frame of said conductor support module is in the shape of a rectangle and is attached at each corner to one of said vertical support members.

15. An offshore platform as defined in claim 12 wherein said vertical spacing between adjacent horizontal conductor support members of said conductor support module is less than said vertical spacing between adjacent horizontal framing members of said offshore platform jacket.

16. An offshore platform as defined in claim 12 wherein said conductor support module further comprises a plurality of diagonal support members attached to said conductor support module in such a manner as to strengthen said conductor support module.

* * * * *